US006570331B2

(12) United States Patent
Arakawa et al.

(10) Patent No.: US 6,570,331 B2
(45) Date of Patent: May 27, 2003

(54) CRT SOCKET

(75) Inventors: Hiroharu Arakawa, Toyama-ken (JP); Atsushi Arai, Toyama-ken (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 10/117,661

(22) Filed: Apr. 4, 2002

(65) Prior Publication Data

US 2002/0158561 A1 Oct. 31, 2002

(30) Foreign Application Priority Data

Apr. 26, 2001 (JP) ..... 2001-130271

(51) Int. Cl.[7] ..... H01J 29/96
(52) U.S. Cl. ..... 315/3; 439/182
(58) Field of Search ..... 315/3; 439/182; 313/325

(56) References Cited

U.S. PATENT DOCUMENTS 4,400,645 A * 8/1983 Simovits et al. ..... 313/325

* cited by examiner

*Primary Examiner*—David Vu
(74) *Attorney, Agent, or Firm*—Darby & Darby

(57) ABSTRACT

A CRT socket includes interfitting vertical walls between first and second focusing pins. The presence of low dielectric constant air between the interfitted walls prevents the occurrence of corona currents between the two focusing terminal pins of a double focus tube and between a focusing terminal pin and a surrounding insulating resin wall. As necessary, insulating walls that also have at least a double-wall construction are formed as the side walls of focusing terminal pin housings that separate the focusing terminal pins from the outside. A gap of at least 1.0 mm is left between the ends of the focusing terminal pins and the side walls and bottoms of focusing terminal pin housings in the base portion.

6 Claims, 7 Drawing Sheets

PRIOR ART

CRT SOCKET

BACKGROUND OF THE INVENTION

1. Field of the Invention

The present invention relates to a CRT (Cathode Ray Tube) socket that connects to the base of a CRT used, for example, as a color television set or display monitor. In particular, the invention relates to a construction that is effective in preventing the generation of corona currents between the ends of two focusing terminal pins on a double focus tube and between the end of a focusing terminal pin and the surrounding insulating resin wall.

2. Description of the Related Art

CRTs are widely used in color television sets and display monitors. As the sizes and resolutions of CRTs have increased, double focus tubes have come into widespread use.

Increases in the sizes of color television sets and display monitors have been accompanied by demands for wide-screen displays and displays with reduced depth. Such demands have resulted in higher voltages being applied to CRTs, so that, in a double focus tube, there is a trend toward a higher potential difference across the two focusing terminal pins. Also, to produce a high resolution display across the entire screen, a high-frequency dynamic voltage waveform is superimposed on one of the focusing terminal pins. As CRT display screens become larger, wider and flatter, higher voltages must be applied using such dynamic voltages.

One example of the construction of a conventional CRT socket is shown in FIGS. 8A and 8B. A stem base 103 is attached to the end of the neck of the CRT. Two focusing terminal pins 101*a* and 101*b* extend through the stem base 103. The CRT socket is attached to the CRT to electrically connect to the focusing terminal pins 101*a* and 101*b*. A single barrier wall 233, made of resin, is interposed between the end of the first focusing terminal pin 101*a* and the end of the second focusing terminal pin 101*b*.

When a high dynamic voltage is applied to one of the focusing terminal pins 101*a* and 101*b*, the resin barrier wall acts as an inductor. This results in the generation of a corona current that causes discoloration and deterioration in the resin barrier wall. This constitutes a technical problem for conventional devices.

Side walls 231*a*, 231*b*, 232*a*, 232*b* of the focusing terminal pin housing are also single walls. The gaps between these side walls and the focusing terminal pins are only about 0.4 mm at their narrowest points. Dust can adhere on these resin side walls of the housing and the walls may become moist, resulting in the side walls acting as an inductor. As above, a corona current flows through the side walls causing discoloration and deterioration in the resin forming the walls. This also constitutes a technical problem for conventional devices.

OBJECTS AND SUMMARY OF THE INVENTION

It is an object of the present invention to provide a CRT socket that overcomes the drawbacks of the prior art.

It is a further object of the invention to provide a construction of a CRT socket that is effective in preventing the generation of corona currents between the two focusing terminal pins in a double focus tube and between a focusing terminal pin and the surrounding insulating resin wall.

A CRT socket according to a first aspect of the present invention includes: a ring-shaped portion that has a cylindrical central hole passing therethrough from a front face to a rear face thereof and signal connecting means which is positioned approximately concentrically with and on an outside of the cylindrical central hole and engages signal terminal pins of a CRT; a cover portion equipped with high voltage connecting means disposed approximately concentrically with the cylindrical central hole and which engages each of two focusing terminal pins of the CRT; and a base portion that corresponds to a rear face of the cover portion, wherein at least two insulating walls are interposed between the ends of the two focusing terminal pins.

With the above construction, at least two insulating resin walls, with an air layer between, are interposed between the ends of the two focusing terminal pins. This means that the path between the two focusing terminal pins must pass through at least one air layer between the two walls. Air has a substantially lower dielectric constant than the resin walls. Accordingly, even if a dynamic high voltage is applied to one of the two focusing terminal pins, the chance of generating a corona current is very small.

A construction with two or more insulating resin walls can be realized in a number of conceivable ways. As a first example, a channel is formed in a barrier wall on the cover portion, with a barrier wall on the base portion fitting into this channel to form a triple-wall construction, as shown in FIGS. 4A and 4B. This offers two air barriers between the two focus terminal pins. In another example, a channel is formed in a barrier wall of the base portion, with a barrier wall on the cover portion fitting into this channel to form a triple-wall construction, as shown in FIGS. 7A and 7B.

A CRT socket according to a second aspect of the present invention includes: a ring-shaped portion that has a cylindrical central hole passing therethrough from a front face to a rear face thereof and signal connecting means which is provided approximately concentrically with and on an outside of the cylindrical central hole and engages signal terminal pins of a CRT; a cover portion equipped with high voltage connecting means that is provided approximately concentrically with the cylindrical central hole and engages a focusing terminal pin of the CRT; and a base portion that is provided so as to correspond to a rear face of the cover portion, wherein a cover-side focusing terminal pin housing is provided in the cover portion and a base-side focusing terminal pin housing is provided in the base portion so as to engage the cover-side focusing terminal pin housing, the housing having at least double insulating side walls that separate the end of the focusing terminal pin from the outside.

With the above construction, at least one extra wall is provided at the narrowest part of the gap between the side wall forming the housing for the end of a focusing terminal pin and the focusing terminal pin itself, so that the focusing terminal pin is surrounded by at least two walls. As a result, even if dust adheres on the outer wall and the outer wall becomes moist, a layer of air with a low dielectric constant is formed between the two walls thereby preventing the generation of corona currents.

A construction where the side walls of the housing have at least a double-wall construction can be achieved as shown in FIGS. 4A and 4B where a side wall formed on the cover portion engages a side wall formed on the base portion to form a double-wall construction, or as shown in FIGS. 7A and 7B where two walls are integrally formed on the base.

A CRT socket according to a third aspect of the present invention includes: a ring-shaped portion that has a cylindrical central hole passing therethrough from a front face to a rear face thereof and signal connecting means approximately concentric with, and on an outside of, the cylindrical central hole and engages signal terminal pins of a CRT; a cover portion equipped with high voltage connecting means that is provided approximately concentrically with the cylindrical central hole and engages a focusing terminal pin of the CRT; and a base portion that is provided so as to correspond to a rear face of the cover portion, wherein a base-side focusing terminal pin housing is provided in the base portion and a gap of at least 1.0 mm is left between the end of the focusing terminal pin and side walls and a bottom of the base-side focusing terminal pin housing.

In a conventional socket, corona currents can easily occur due to the narrow (0.4 mm) gap between the end of a focusing terminal pin and the side walls of the housing. With the present invention, a gap of at least 1.0 mm, and preferably at least 1.5 mm, is left between the end of a focusing terminal pin and the bottom and side walls of the housing. Since air has a low dielectric constant, this extra distance is effective in preventing the generation of corona currents.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
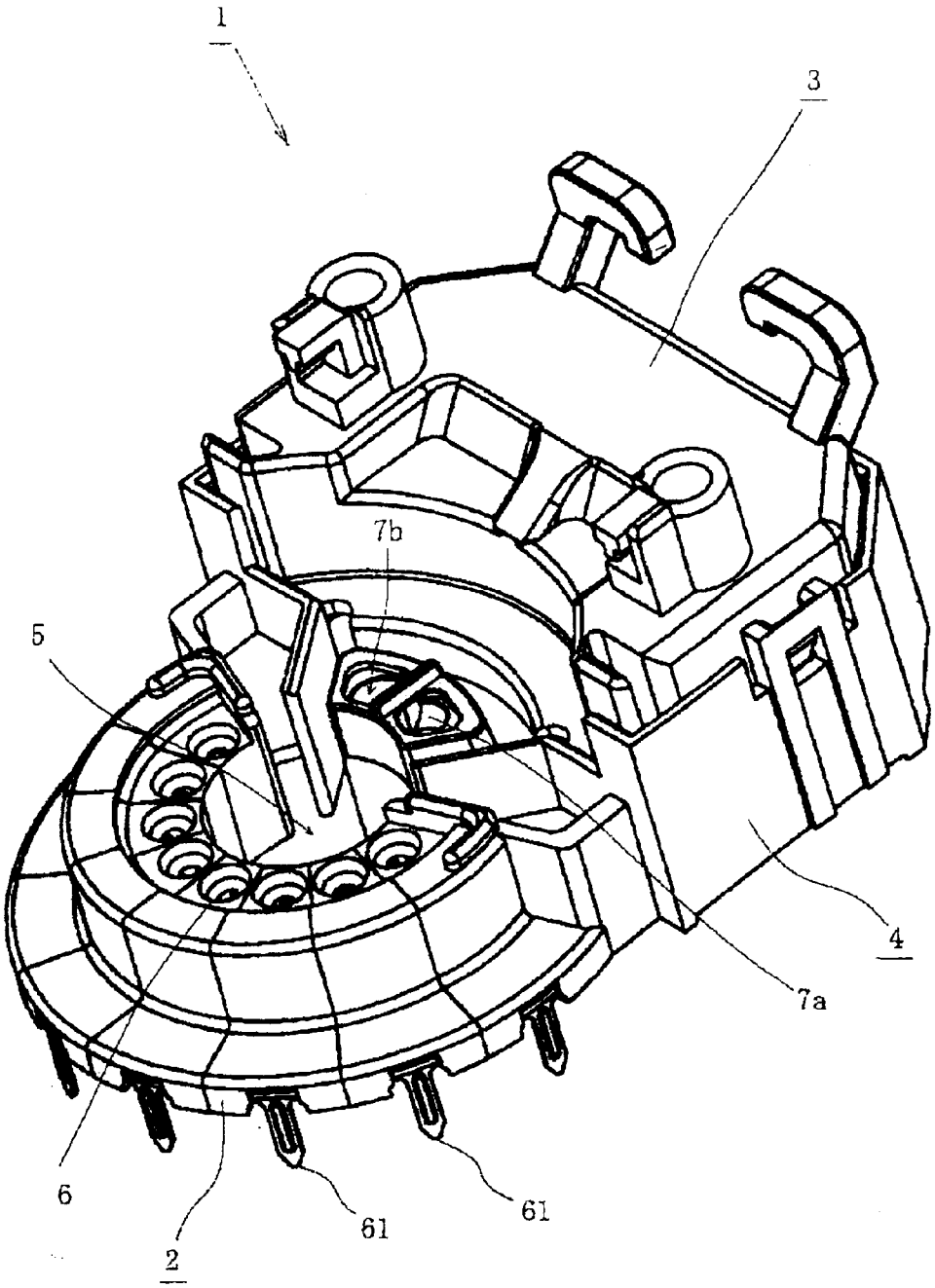
FIG. 1 is a perspective view showing the front of a CRT socket 1 according to the present invention.
Figure 2:
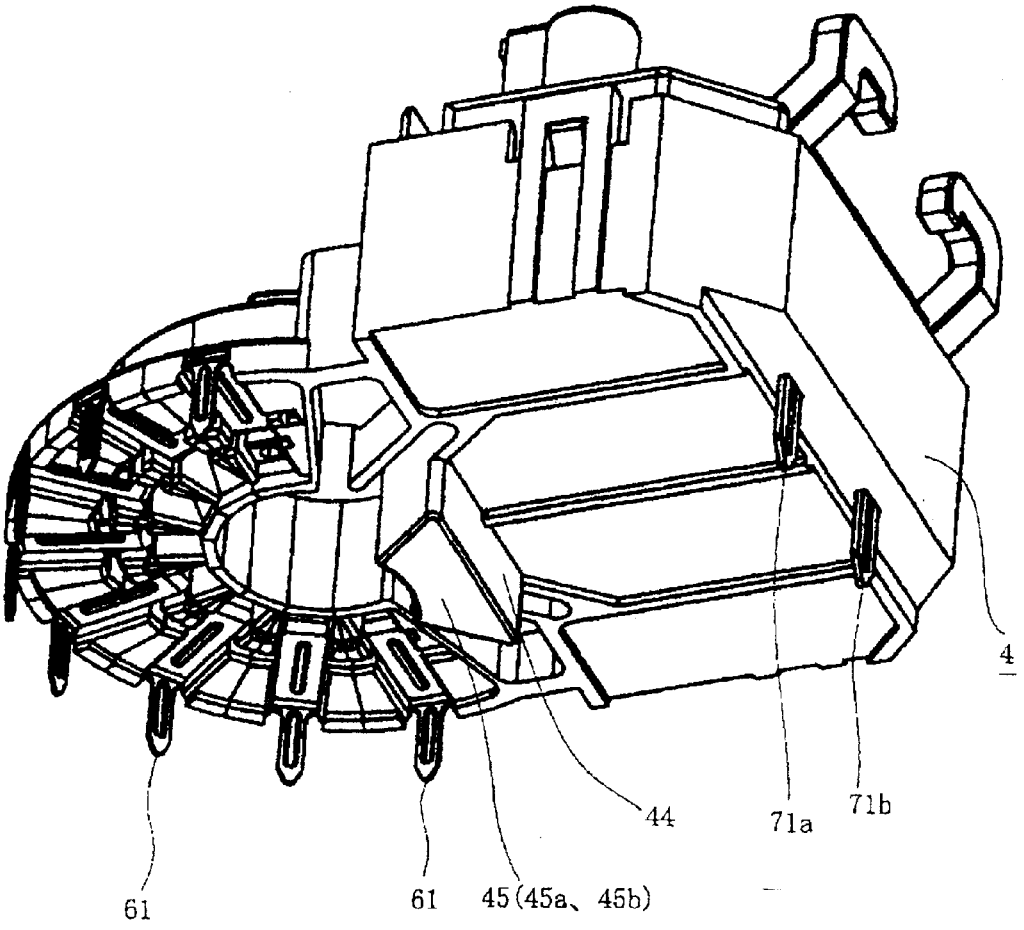
FIG. 2 is a rear perspective view showing the rear of the CRT socket 1 according to the present invention.
Figure 3:
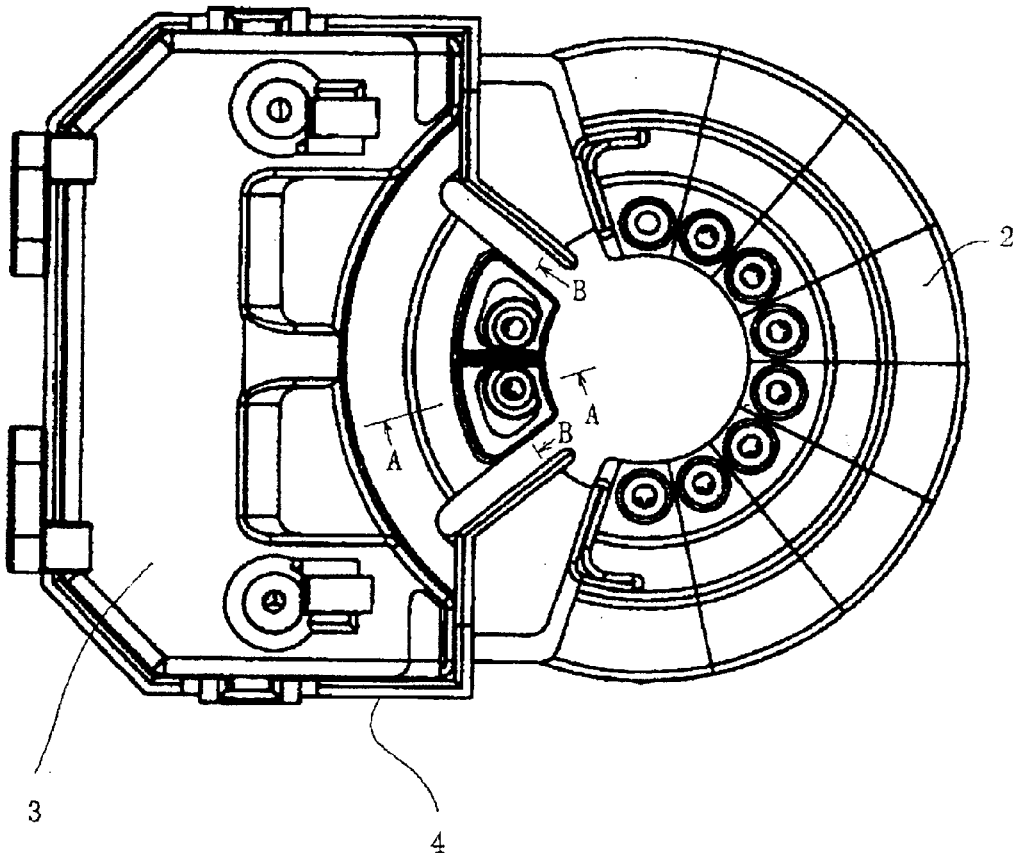
FIG. 3 is a plan view of the CRT socket 1 according to the present invention.

Referring to FIGS. 1–4A/4B, a CRT socket 1, according to the invention, has a cylindrical center hole 5 that fits over a stem base 103 which covers a glass vacuum seal 104 of a neck end 100 of a CRT. The CRT socket 1 is composed of a ring-shaped portion 2, a cover portion 3, and a base portion 4. The ring-shaped portion 2 has a plurality of signal contact holes 6 on its front side at positions that are approximately concentric with the cylindrical center hole 5. A plurality of signal contacts 61 are arranged on a rear side of the ring-shaped portion. Ground metal members 62 are spaced a predetermined distance from the signal contacts 61 to form discharge gaps between them. The cover portion 3 has focus contact holes 7A, 7B on its front side at positions that are approximately concentric with the cylindrical center hole 5. Focus contacts 71*a* and 71*b* are disposed within focus contact holes 7A and 7B, respectively, at a rear side thereof. The base portion 4 is shaped to conform to the rear of the cover portion 3.

Referring specifically to FIG. 3, FIGS. 4A and 4B and FIGS. 5A and 5B the focusing terminal pins 101*a* and 101*b* are shown inserted into the focus contact holes 7A and 7B where they are connected to the focus contacts 71*a* and 71*b* in the CRT socket.

Figure 5A:
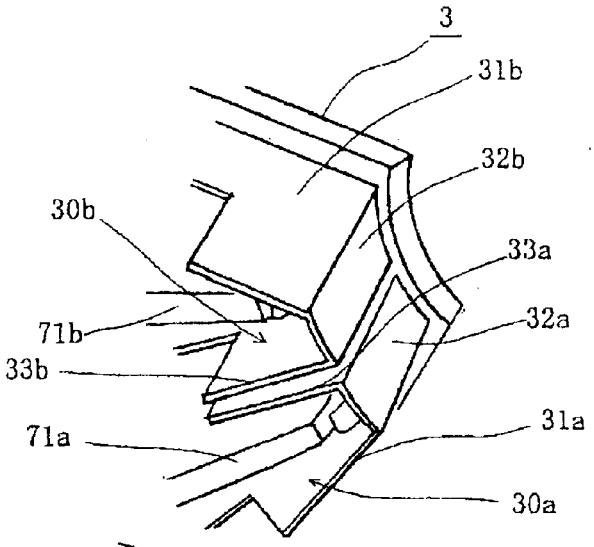
FIGS. 5A and 5B are perspective views of housings.
Figure 5B:
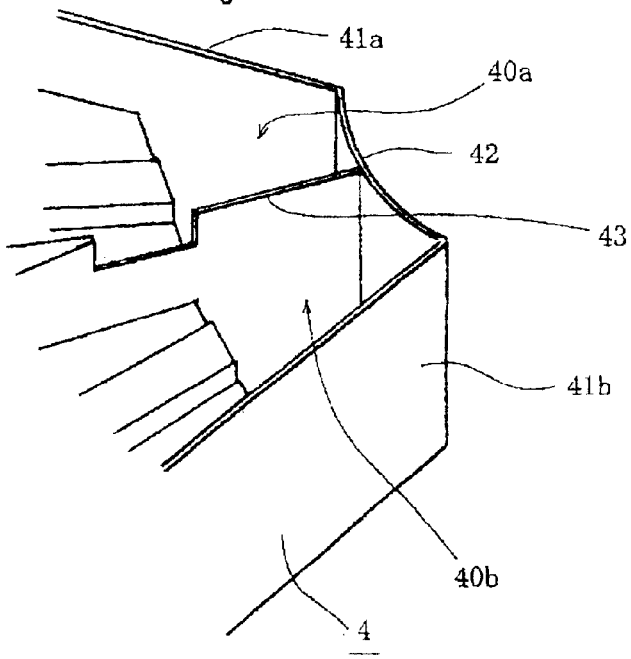

Referring to FIGS. 5A and 5B, the cover portion 3 includes a first cover housing 30*a* which houses a first focusing terminal pin 101*a*. The cover portion is formed by a first cover side wall 31*a*, a first cover central hole side wall 32*a*, and a first cover barrier wall 33*a*. A second cover housing 30*b* houses a second focusing terminal pin 101*b*, formed by a second cover side wall 31*b*, a second cover central hole side wall 32*b*, and a second cover barrier wall 33*b*.

On the base portion 4, a first base side wall 41*a*, a base central hole side wall 42, a second base side wall 41*b* and a base barrier wall 43 form a first base housing 40*a* and second base housing 40*b* that enclose the housings formed in the cover portion 3.

Figure 4A:
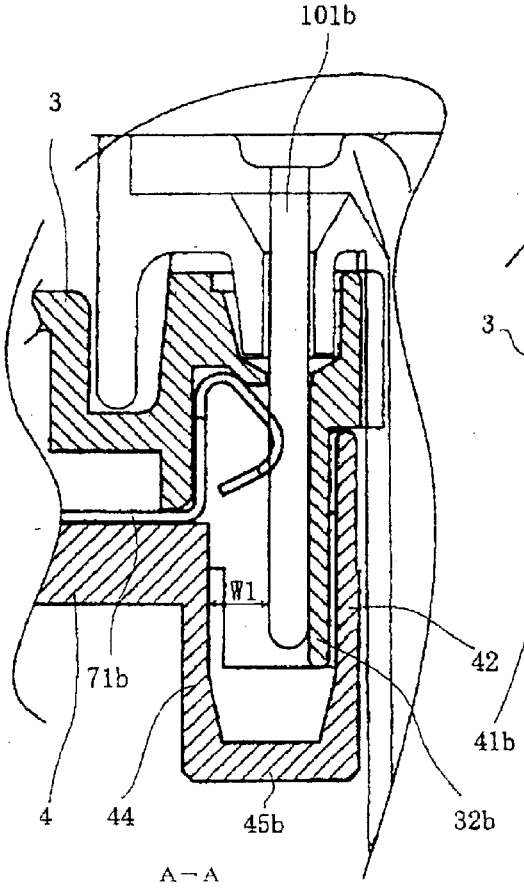
FIGS. 4A and 4B are cross-sectional views respectively taken along lines A—A and B—B of FIG. 3.
Figure 4B:
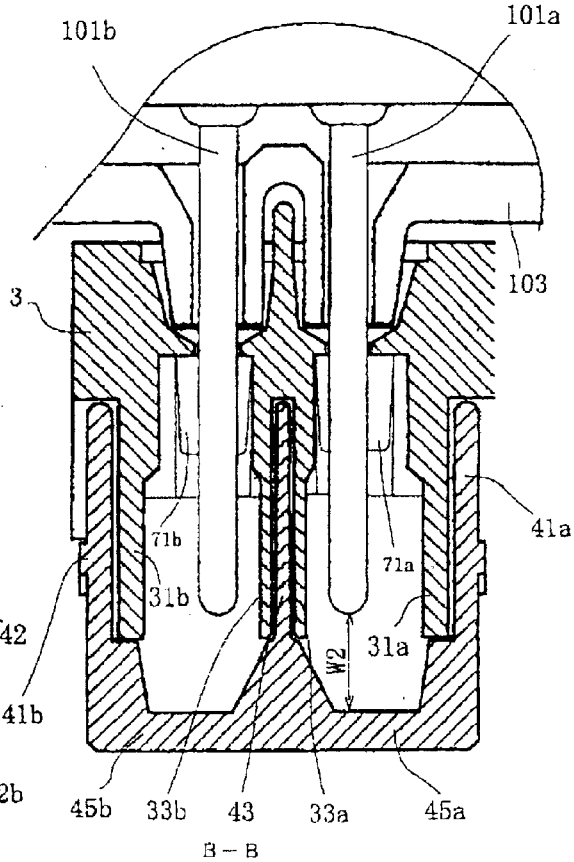

The cover portion 3 and base portion 4 are fitted together as shown in FIG. 4A and FIG. 4B, to form a triple-wall construction. This places the first cover barrier wall 33*a*, the base barrier wall 43, with the second cover barrier wall 33*b* between the first focusing terminal pin 101*a* and the second focusing terminal pin 101*b*.

As shown in FIG. 4A and FIG. 4B, the housing side walls (31*a*, 41*a*) and (31*b*, 41*b*) and the central hole side walls (32*a*, 42) and (32*b*, 42) form double-wall constructions. Gaps W1 between the ends of the focusing terminal pins 101*a* and 101*b* and a surrounding wall 44 and gaps W2 between the ends of the focusing terminal pins 101*a* and 101*b* and the bottoms of the first and second housings are set at 1.5 mm.

Figure 6:
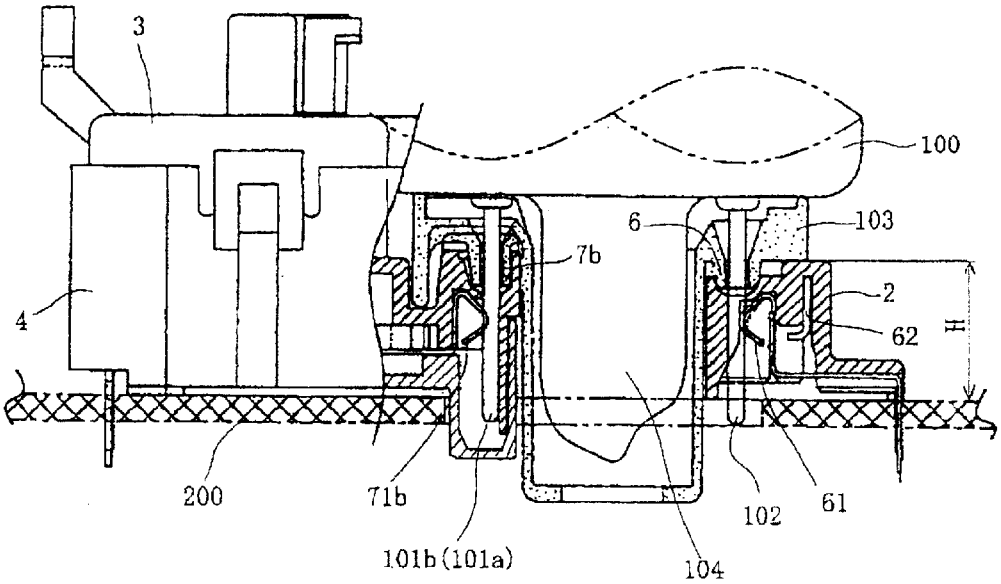
FIG. 6 is a side elevation of a CRT socket 1 showing the main parts in cross-section.

As shown in FIG. 6, the first and second base housings project outward beyond a rear side of a circuit board 200. To accomplish this, the opening in the circuit board is enlarged compared to the prior art. This permits reduction of the height H (measured from the circuit board) at which the CRT is engaged by the CRT socket without requiring shortening the terminal pins of the CRT. This allows a corresponding reduction to be made in the thickness of the CRT socket while leaving a large gap W2, as shown in FIG. 4B.

Figure 7A:
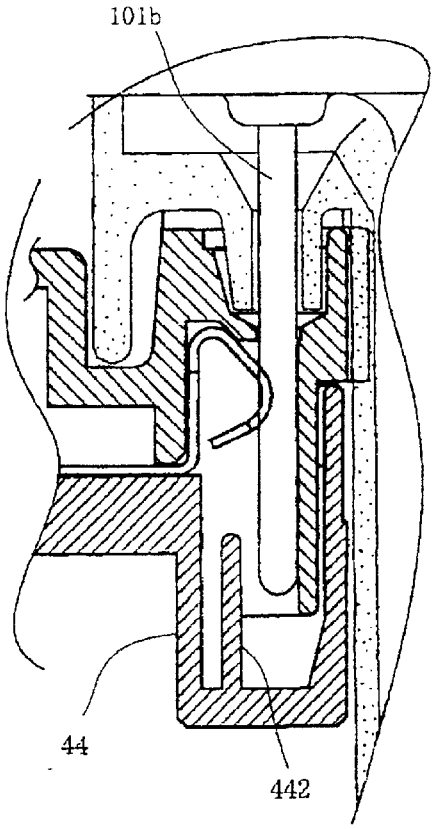
FIGS. 7A and 7B show a modification of a CRT socket according to the present invention.
Figure 7B:
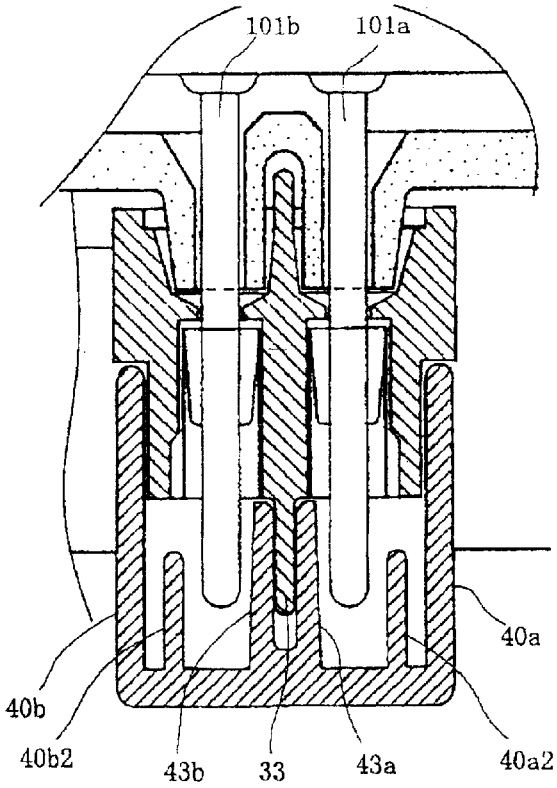
Figure 8A:
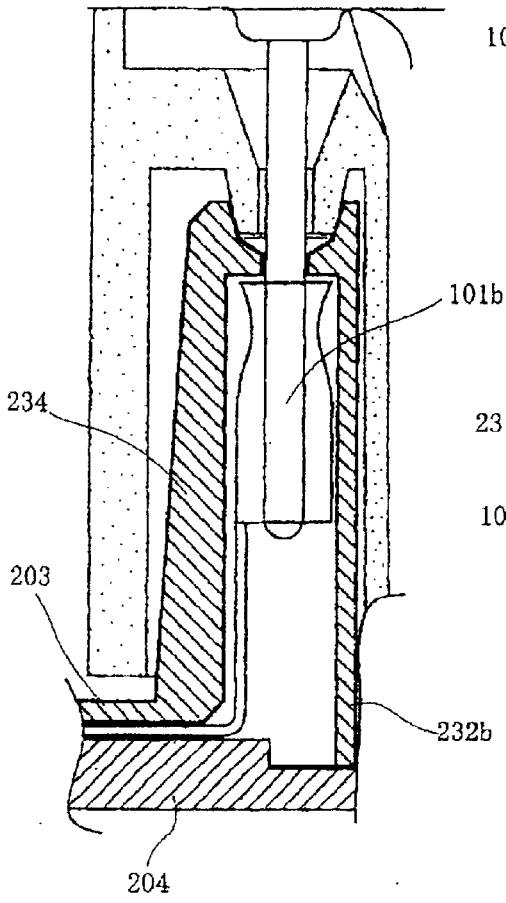
FIGS. 8A and 8B show the construction of one example of a conventional housing.
Figure 8B:
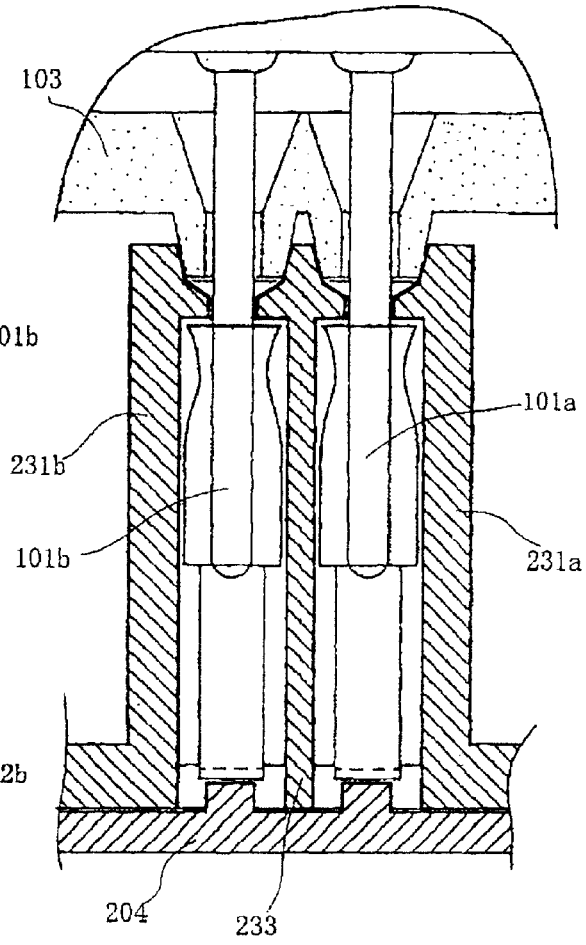
PRIOR ART Fig. 8B

FIG. 7A and FIG. 7B show a modification of the present invention. In this modification, a housing with a double-wall construction is formed on the base portion. A first base barrier wall 43*a* and a second base barrier wall 43*b* project upward from the base portion. The cover barrier wall 33 of the base portion fits between these barrier walls 43*a* and 43*b* to form a triple-wall construction. In addition, a first base inner side wall 40*a*2 is disposed at the narrowest part of the gap between the first base side wall 40*a* and the first focusing terminal pin 101*a*. A second base inner side wall 40*b*2 is disposed at the narrowest part of the gap between the second base side wall 40*b* and the second focusing terminal pin 101*b*. An inner surrounding wall 442 is provided at the narrowest part of the gap between the surrounding wall 44 and the first and second focusing terminal pins (101*a*, 101*b*), thereby forming double-wall constructions.

Conventionally, a single resin wall is used as the insulating wall that surrounds the ends of the focusing terminal pins. When a dynamic high voltage is applied to one of the focusing terminal pins, a corona current flows through the resin wall, resulting in change of color and deterioration in the resin wall. In view of this problem, according to the first aspect of the present invention, at least two resin walls are provided between two focusing terminal pins, so that the generation of corona currents between the pins is prevented.

According to the second aspect of the present invention, each focusing terminal pin is surrounded by at least two side walls in the housing, so that the generation of corona currents is prevented even when dust adheres on the outer wall and the outer wall becomes moist. According to the third aspect of the present invention, the above construction of two or more resin insulating walls is replaced with a construction where the generation of corona currents is prevented by including a layer of air in the path. Air, of course has a much lower dielectric constant than resin. With a thickness of at least 1.0 mm, corona currents remain blocked.

It should be noted that the second and third aspects of the present invention do not need to be realized separately, and so may be combined in a single construction.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims. Thus, the claims shall be considered to define all such modifications as fall within the true spirit and scope of the invention.

What is claimed is:

1. A CRT (Cathode Ray Tube) socket, comprising:

a ring-shaped portion;

a cylindrical central hole passing through said ring-shaped portion from a front face to a rear face thereof;

signal connecting means in said ring-shaped portion located concentrically with, and on an outside of, said cylindrical central hole;

said signal connecting means being of a type which engage signal terminal pins of a CRT;

a cover portion;

high voltage connecting means in said cover portion located approximately concentrically with said cylindrical central hole;

said high voltage connecting means including means for engaging each of two focusing terminal pins of said CRT;

a base portion corresponding to a rear face of said cover portion, at least one of said base portion and said cover portion forming at least two insulating walls between ends of said two focusing terminal pins.

2. A CRT socket, comprising:

a ring-shaped portion;

a cylindrical central hole passing through said ring-shaped portion from a front face to a rear face thereof;

signal connecting means approximately concentrically located with, and on an outside of, said cylindrical central hole;

said signal connecting means including means for engaging signal terminal pins of a CRT;

a cover portion equipped with high voltage connecting means that is provided approximately concentrically with said cylindrical central hole and engages a focusing terminal pin of said CRT;

a base portion corresponding to a rear face of said cover portion, a cover-side focusing terminal pin housing in said cover portion;

a base-side focusing terminal pin housing in said base portion so as to engage said cover-side focusing terminal pin housing, said housing forming at least double insulating side walls that separate an end of said focusing terminal pin from the outside.

3. A CRT socket, comprising:

a ring-shaped portion;

a cylindrical central hole in said ring-shaped portion passing therethrough from a front face to a rear face thereof;

signal connecting means disposed approximately concentrically with, and on an outside of, said cylindrical central hole;

said signal connecting means including means for engaging signal terminal pins of a CRT;

a cover portion;

said cover portion including high voltage connecting means located approximately concentrically with said cylindrical central hole;

said high voltage connecting means including means for engaging a focusing terminal pin of said CRT;

a base portion corresponding to a rear face of said cover portion; and a base-side focusing terminal pin housing in said base portion forming a gap of at least 1.0 mm between an end of said focusing terminal pin and side walls and a bottom of said base-side focusing terminal pin housing.

4. A focusing terminal pin housing in a CRT socket comprising:

a base portion;

a cover portion;

said cover portion including first and second focusing pin openings for insertion of CRT focusing pins therein;

a first central wall dividing said base portion to separate regions for said first and second focusing pins;

a second central wall corresponding to said first central wall;

one of said first and second central walls being divided into first and second walls between said separate regions; and the other of said first and second walls including a member fitting into said first and second walls, whereby a double air barrier is formed between ends of said first and second focusing pins.

5. Apparatus according to claim 4, wherein said one includes said first central wall.

6. Apparatus according to claim 4, wherein said one includes said second central wall.

* * * * *